US008326135B1

(12) United States Patent
Gose

(10) Patent No.: US 8,326,135 B1
(45) Date of Patent: Dec. 4, 2012

(54) HEAT LAMP WITH DISPERSING FAN

(76) Inventor: Kent W. Gose, Enid, OK (US)

( * ) Notice: Subject to any disclaimer, the term of this patent is extended or adjusted under 35 U.S.C. 154(b) by 984 days.

(21) Appl. No.: 12/321,840

(22) Filed: Jan. 26, 2009

Related U.S. Application Data

(60) Provisional application No. 61/062,255, filed on Jan. 25, 2008.

(51) Int. Cl.
*F24C 1/14* (2006.01)

(52) U.S. Cl. ..... 392/375; 392/381; 392/383

(58) Field of Classification Search ..... 392/381, 392/383, 375
See application file for complete search history.

(56) References Cited

U.S. PATENT DOCUMENTS

| | | | | | |
|---|---|---|---|---|---|
| 939,106 | A * | 11/1909 | Soles | 392/426 |
| 1,426,604 | A * | 8/1922 | Roys | 392/383 |
| 1,660,801 | A * | 2/1928 | Martin | 392/383 |
| 1,686,024 | A * | 10/1928 | Meyer | 392/379 |
| 1,730,982 | A * | 10/1929 | Pankratz et al. | 392/368 |
| 1,756,033 | A * | 4/1930 | Nordan | 392/361 |
| 1,961,772 | A * | 6/1934 | Martin | 392/383 |
| 2,153,239 | A * | 4/1939 | Curci | 392/383 |
| 2,456,881 | A * | 12/1948 | Leather | 392/383 |
| 3,686,774 | A * | 8/1972 | Beadle, Jr. | 34/227 |
| 3,864,547 | A | 2/1975 | Ray | |
| 4,263,500 | A * | 4/1981 | Springer et al. | 392/410 |
| 4,835,367 | A | 5/1989 | Hoffman | |
| 5,404,652 | A | 4/1995 | Sher | |
| 5,671,321 | A * | 9/1997 | Bagnuolo | 392/385 |
| 6,205,677 | B1 * | 3/2001 | Yune | 34/266 |
| 6,381,407 | B2 * | 4/2002 | Choi | 392/376 |
| 6,610,082 | B2 * | 8/2003 | Park | 607/96 |
| 7,166,821 | B2 | 1/2007 | Adamski | |

* cited by examiner

*Primary Examiner* — Thor Campbell
(74) *Attorney, Agent, or Firm* — Montgomery Patent & Design, LLC; Robert C. Montgomery; Joseph Yaksich

(57) ABSTRACT

A portable area heating apparatus that utilizes a heat lamp for the heat source and a rear-situated fan to disperse the heated air is herein disclosed. The apparatus is intended for use in spot heating applications such as garages, workshops, and similar locations and is suitable for mounting on a floor or wall by use of a multi-functional bracket assembly. Since the heat lamp also produces a certain amount of light, the apparatus may also be used as a light source. The apparatus could also be mounted within an existing ductwork system to supplement a conventional central heating system in areas where extra heat is needed.

17 Claims, 9 Drawing Sheets

HEAT LAMP WITH DISPERSING FAN

RELATED APPLICATIONS

The present invention was first described in and claims the benefit of U.S. Provisional Patent Application No. 61/062,255 on Jan. 25, 2008 the entire disclosures of which are incorporated herein by reference.

FIELD OF THE INVENTION

The present invention relates generally to a portable heating means comprising a housing mountable thereto a desired location with an adjustable mounting assembly, a fan assembly, and a heating illumination assembly.

BACKGROUND OF THE INVENTION

Various types of conventional heating devices are available which create heat through electricity passing through a resistance element or through the combustion of various resources. Some areas, such as garages, work shops and the like are difficult or expensive to heat due to excessive heat loss, faulty insulation, and the frequency of use. Attempts to heat these areas by conventional means typically meet with failure due to cycle time issues, air stagnation, and similar problems. Other solutions such as floor mounted portable heaters are noisy, smelly, and are hazardous. Accordingly, there exists a need for a means by which living or working spaces can be provided with spot or supplemental heat in a cost effective manner without the disadvantages listed above. The development of the device herein described fulfills this need.

The invention is an apparatus comprising a portable spot heat source that utilizes a heat lamp for the heat source and a rear-situated fan to disperse the heated air. The apparatus is intended for use in spot heating applications such as garages, workshops, and similar locations and is suitable for direct mounting by use of a multi-purpose bracket assembly. Since the heat lamp also produces a light, it can also be used as a light source or a work lamp. The apparatus could also be mounted within existing ductwork to supplement other conventional central heating systems for areas that are colder.

Several attempts have been made in the past to provide a portable heat generating means particularly using bulbs or lamps. U.S. Pat. No. 6,381,407, issued in the name of Choi, describes heat generating apparatus comprising a detachable halogen bulb, a reflective mirror, and a small fan to force air flow over the bulb. However, unlike the present invention, the Choi lamp heat generating apparatus utilizes a halogen bulb as a heat source which has the disadvantages of multiple safety concerns since any surface contamination can lead to failure or explosion, the bulbs are prone to ignite flammable objects which may come in contact with said bulb, and may cause burns to the skin. Additionally the present apparatus, while not generating as high of an operating temperatures, can be a more effective heater due to the increased surface area of the incandescent heat lamp over which the forces air travel.

U.S. Pat. No. 6,610,082, issued in the name of Park, discloses an electric fan with far infrared ray lamp comprising a motor driven fan and a far infrared ray lamp placed in front of said fan. However, unlike the present apparatus, the Park lamp utilizes an infrared lamp as a method of delivering therapeutic electromagnetic radiation to the skin of a user and is of no use as means for spot heating and illumination.

U.S. Pat. No. 5,404,652, issued in the name of Sher, discloses a portable heater comprising a heat generating bulb, a plurality of heat distribution devices and a fan to distribute the heated air through directional tubes to a desired location. However, unlike the present apparatus, the Sher portable heater for personal use is intended to be used as a small personal body warmer.

Other known prior art heat generating and dispersing apparatuses includes U.S. Pat. Nos. 3,864,547 and 4,835,367.

While these devices fulfill their respective, particular objectives and appear to disclose various attempts to generate heat and light through the use of an illumination device such as a bulb or lamp; none of the prior art particularly discloses a heat lamp with dispersing fan comprising a portable spot heat source that utilizes a heat lamp for the heat source and a rear-situated fan to disperse cold air over said heat lamp creating a heated air flow. Accordingly, there exists a need for a heat lamp with dispersing fan apparatus that operates without the disadvantages as described above.

SUMMARY OF THE INVENTION

In view of the foregoing prior art, the present apparatus is contemplated to solve the aforementioned inherent disadvantages and it has been observed that there is need for a heat lamp with dispersing fan which provides a portable means for distributing heated air.

To achieve the above objectives, it is an objective of the present apparatus to provide a heat lamp with dispersing fan comprising a bracket assembly, a lamp/fan assembly, and a thermostatic controller which provides a portable and mountable means of dispersing both light and heated air to a desired location.

A further object of the present apparatus is to provide a bracket assembly comprising a bracket base, a stationary jaw, a movable jaw, an adjusting shaft, and a clamping ring which provides a means of securing and of multi-directional positioning the lamp/fan assembly to a desired position upon an object.

Yet another object of the present apparatus is to provide a lamp/fan assembly comprising a housing, a fan, an inlet air vent, an outlet air vent, a heat lamp, a lamp socket, and a conical visor which provides a means of directing illumination and heated air upon a desired object.

Yet still another object of the present apparatus is to provide a clamping ring which provides a means of clamping and securing the housing of the lamp/fan assembly via a pair of fastened pinch plates. The clamping ring is angularly adjustable by attachment to the bracket base via an angle bracket which attaches to another pair of fastened pinch plates.

Yet still another object of the present apparatus is to provide a low profile fan which is inserted into an open rear end of the housing which provides a means of directing a cold air flow from the inlet air vents over the heat lamp and further directing a now heated air flow through the outlet air vents from the front of said housing.

Yet still another object of the present apparatus is to provide a heat lamp which connects to and is powered by a lamp socket and electrical wiring which provides a means of heating the cold air flow and illuminating a desired area.

Yet still another object of the present apparatus is to provide a thermostatic controller switch comprising a set-point dial which provides a means of activation to the lamp/fan assembly based upon a sensed ambient temperature and a selected set point.

Yet still another object of the present apparatus is to provide an over temperature limit cutoff switch which is located inline with the electrical wiring from the controller switch to the heat lamp and the fan which provides a means of shutting off the apparatus when operation outside of a designated temperature limit is reached.

Yet still another object of the present apparatus is to provide a pair of clamping jaws comprising a stationary jaw and a movable jaw which provides a means of clamping the bracket assembly and the attached lamp/fan assembly to a structural member. The movable jaw slidingly engage a pair of guide rods while a threaded shaft drives said movable jaw relative to said stationary jaw.

Yet still another objective of the present apparatus is to provide various alternative means of mounting, securing, and setting up the lamp/fan assembly.

Yet still another object of the present apparatus is to provide a method for utilizing a heat lamp with dispersing fan.

Further objects and advantages of the present apparatus will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

| | |
|---|---|
| 10 | heat lamp with dispersing fan |
| 20 | bracket assembly |
| 21 | bracket base |
| 22 | first pinch plate |
| 23 | angle bracket |

-continued

| | |
|---|---|
| 24 | adjusting handle |
| 26 | adjusting shaft |
| 27 | retaining ring |
| 28 | stationary jaw |
| 29 | first foot |
| 30 | movable jaw |
| 31 | second foot |
| 32 | guide rod |
| 33 | guide rod aperture |
| 34 | threaded shaft |
| 35 | stationary nut |
| 36 | clamping ring |
| 38 | second pinch plate |
| 40 | pad |
| 42 | grommet |
| 50 | lamp/fan assembly |
| 52 | housing |
| 54 | fan cover |
| 56 | housing flange |
| 57 | inlet air vent |
| 58 | visor |
| 60 | outlet air vent |
| 62 | heat lamp |
| 63 | set-point dial |
| 65 | cord |
| 66 | thermostatic controller |
| 67 | wiring |
| 68 | over-temperature limit cutoff switch |
| 69 | terminal strip |
| 70 | fan |
| 72 | lamp socket |
| 80 | fastener |
| 100 | cool air |
| 110 | warmed air |
| 120 | duct |
| 130 | duct bracket |
| 140 | floor surface |
| 150 | ceiling surface |
| 160 | structural member |

DETAILED DESCRIPTION OF THE PREFERRED EMBODIMENT

Figure 3:
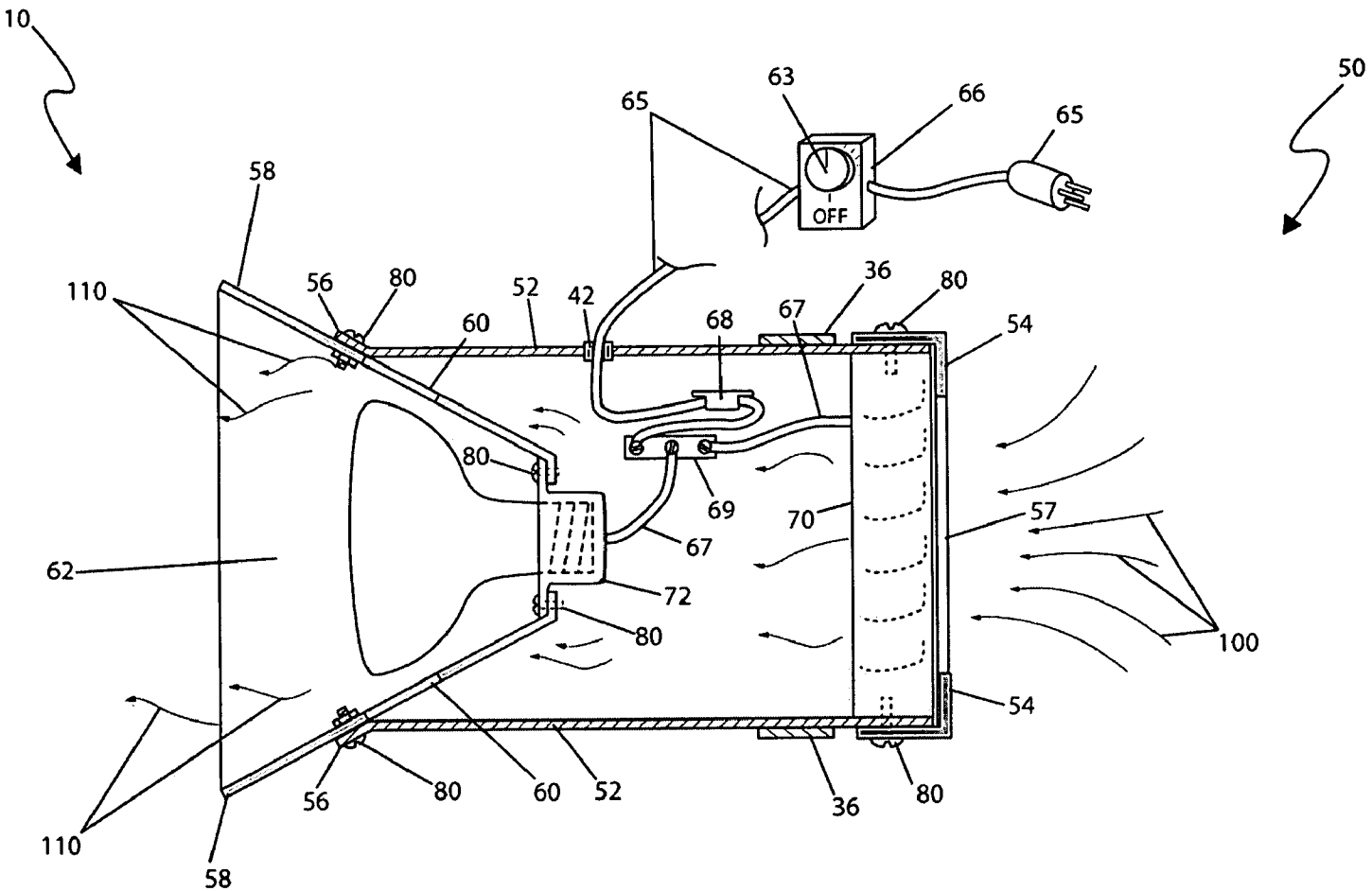
FIG. 3 is a section view taken along section A-A (see FIG. 1) of the heat lamp with dispersing fan 10, according to the preferred embodiment of the present invention.
Figure 4:
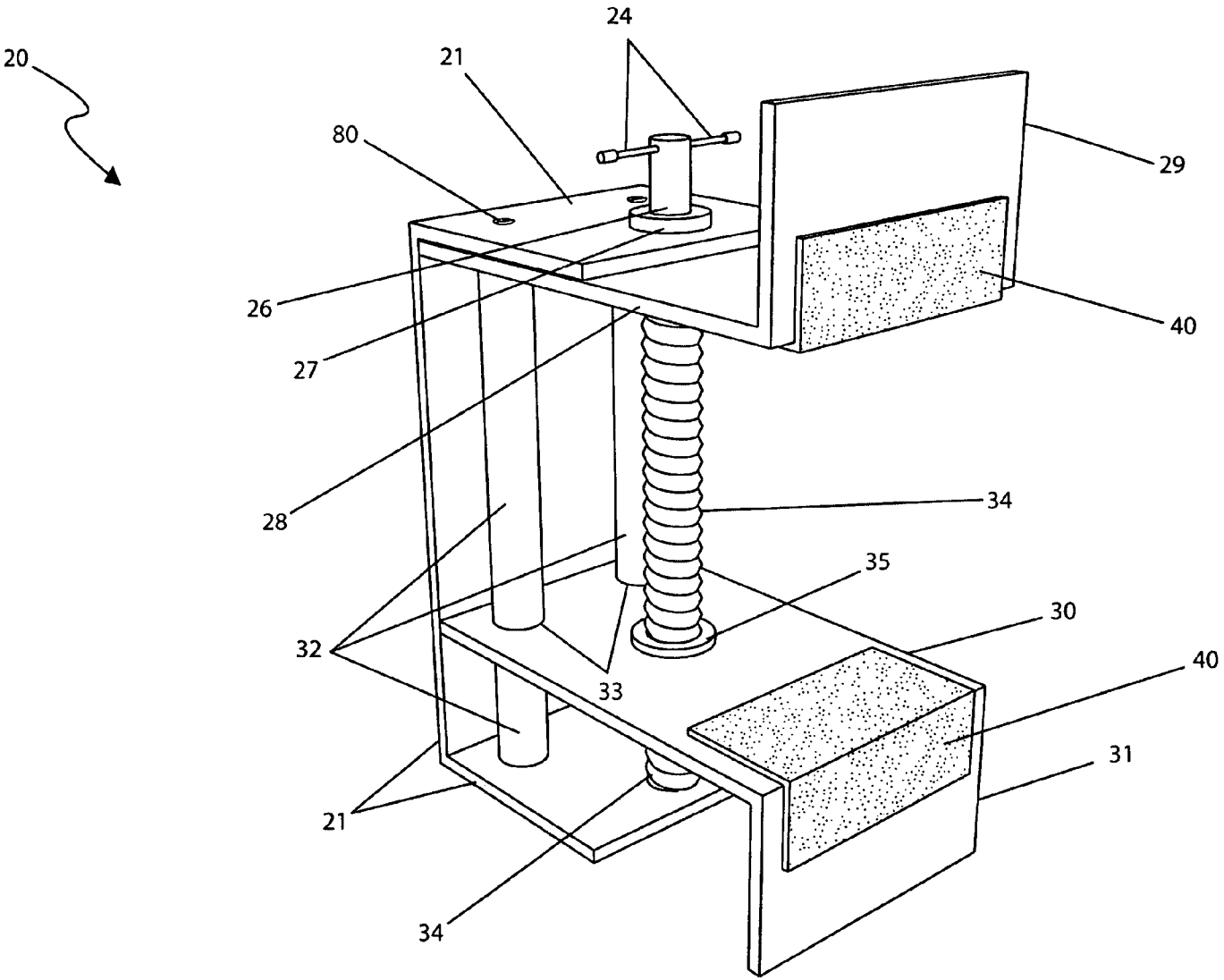
FIG. 4 is a rear perspective view of the bracket assembly portion 20 of the heat lamp with dispersing fan 10, according to the preferred embodiment of the present invention.
Figure 5A:
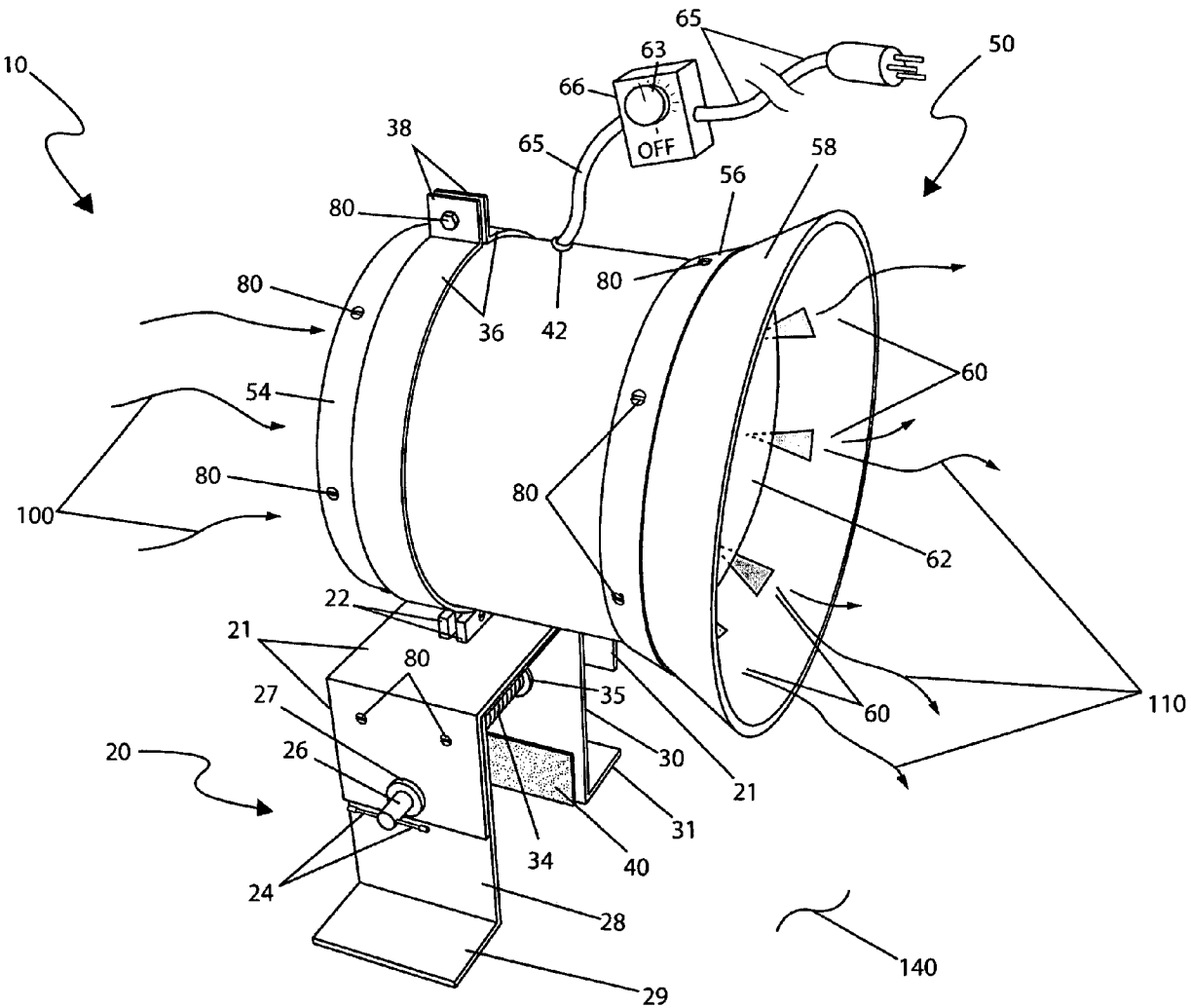
FIG. 5*a* is an environmental view of the heat lamp with dispersing fan 10, depicting a floor standing arrangement, according to the preferred embodiment of the present invention.
Figure 5B:
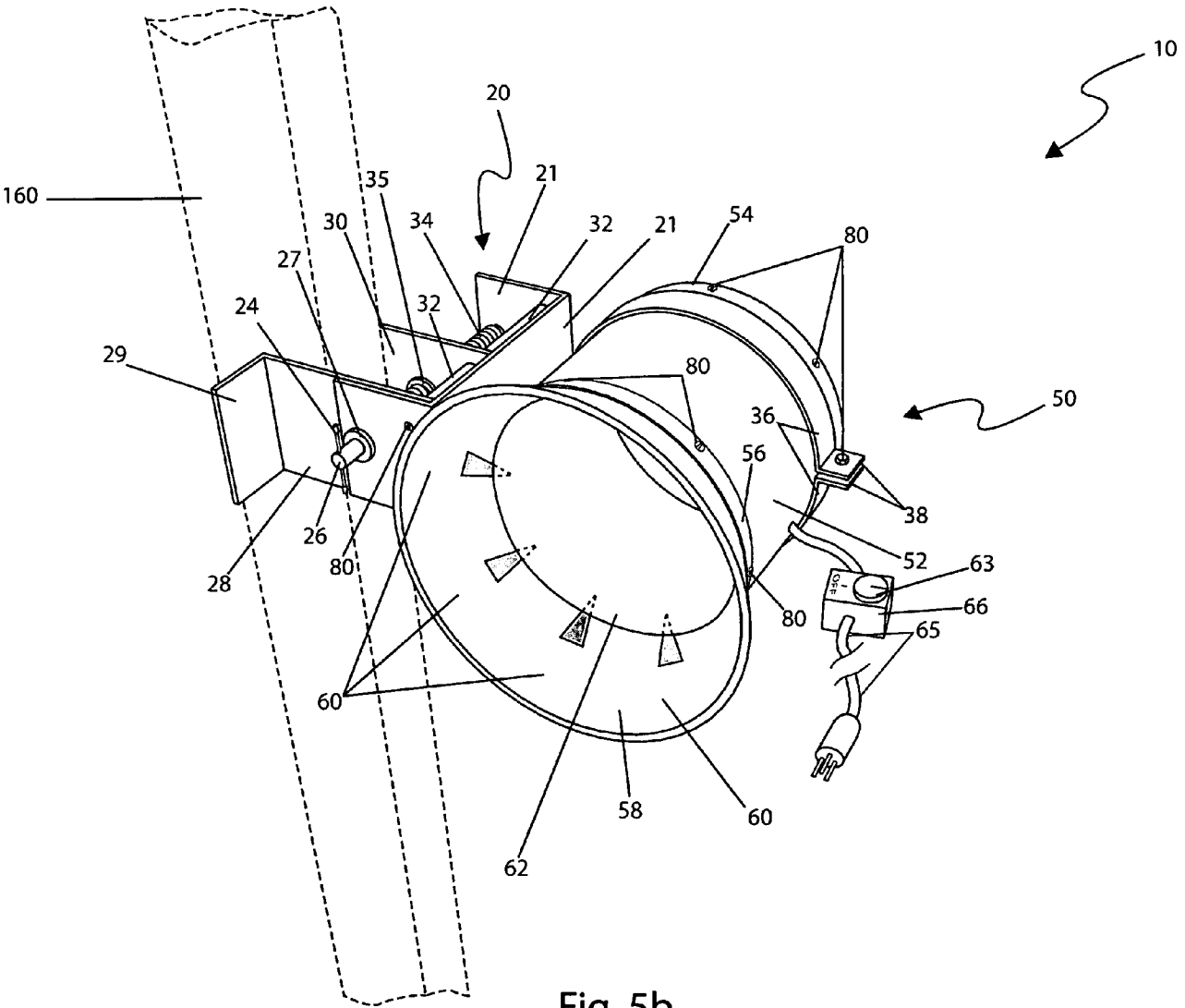
FIG. 5*b* is an environmental view of the heat lamp with dispersing fan 10, depicting an alternate wall mounting arrangement of the present invention.
Figure 5C:
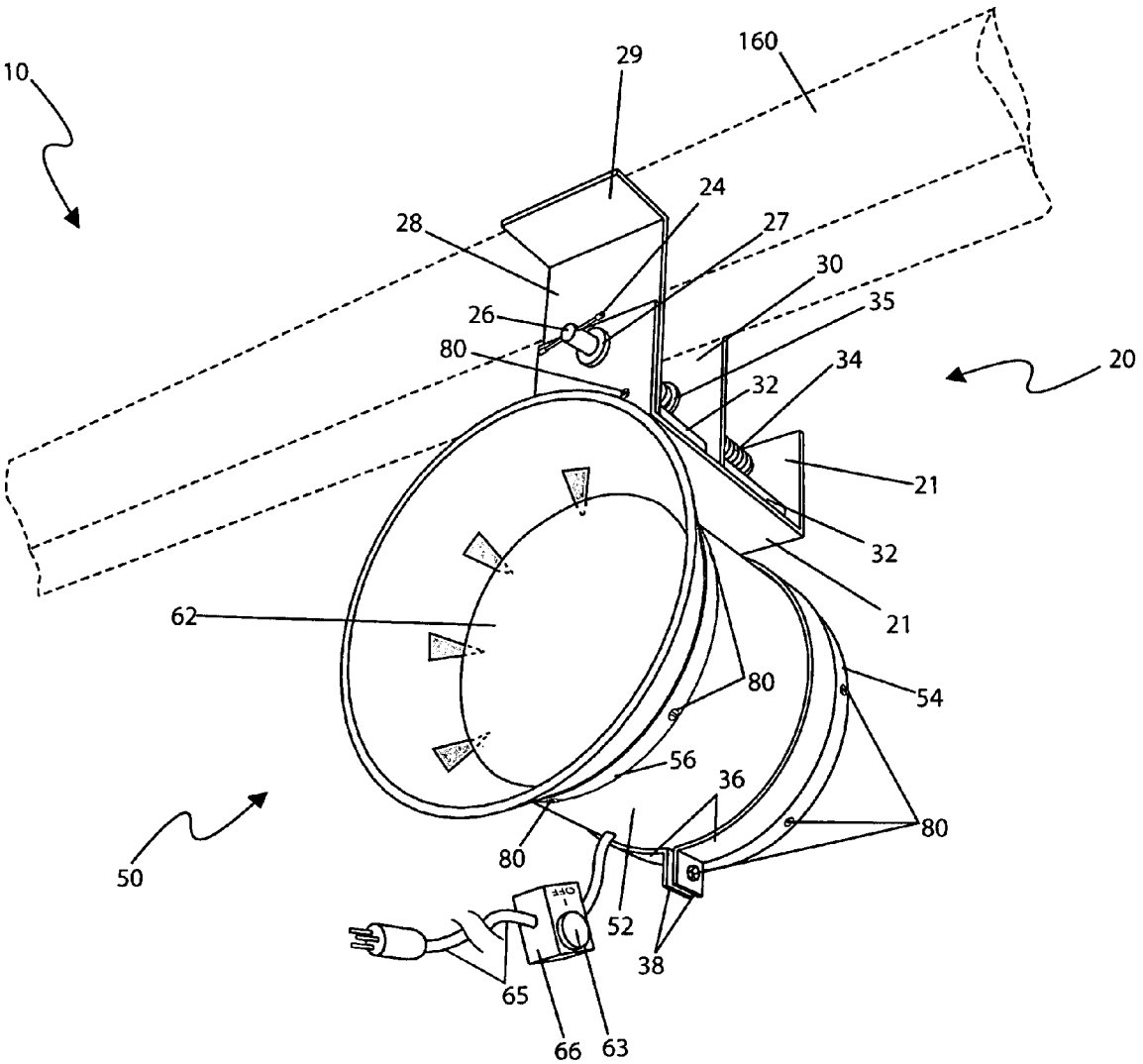
FIG. 5*c* is an environmental view of the heat lamp with dispersing fan 10, depicting an alternate ceiling mounting arrangement of the present invention.
Figure 5D:
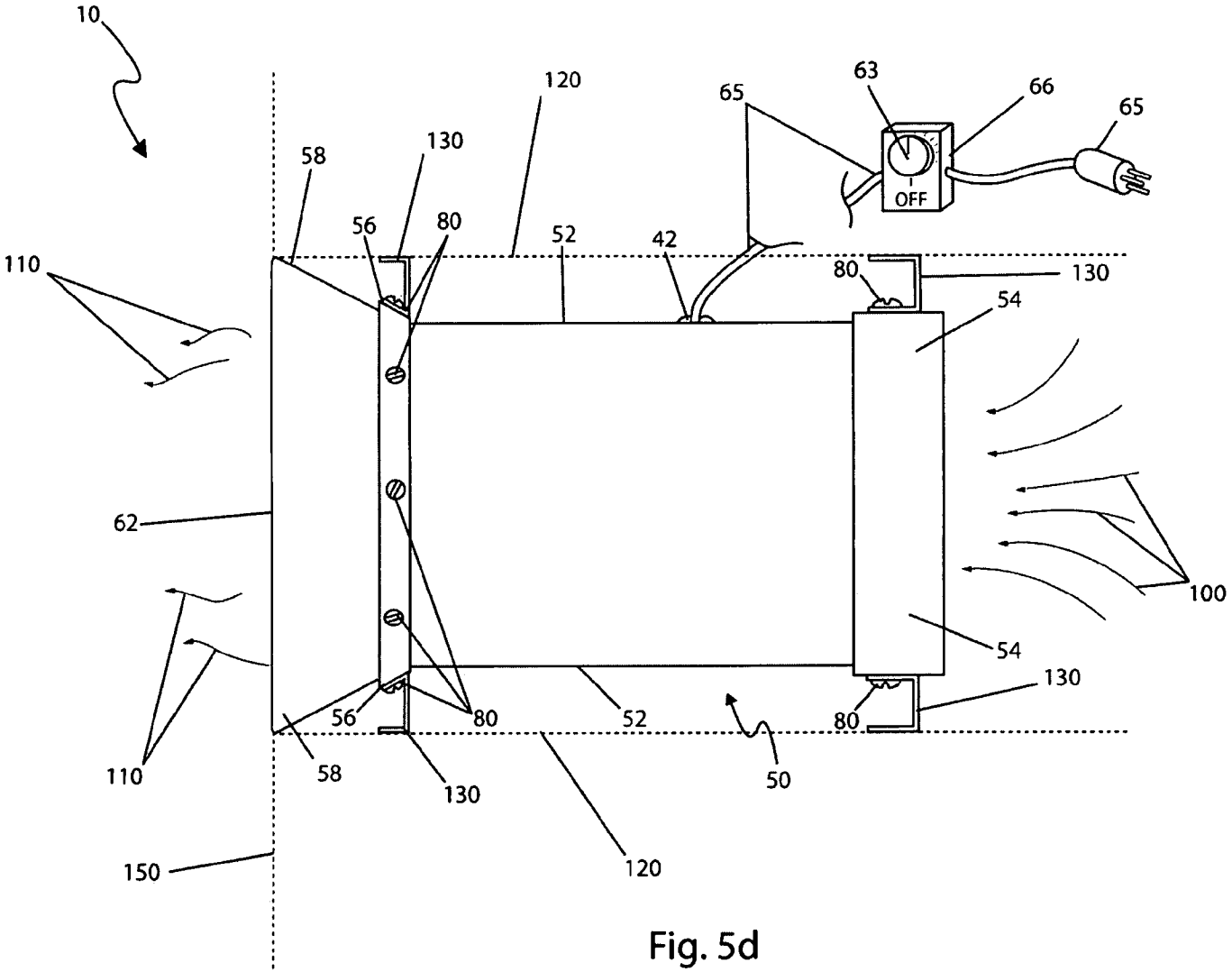
FIG. 5*d* is an environmental view of the heat lamp with dispersing fan 10, depicting an alternate in-line ductwork mounting arrangement of the present invention; and, FIG. 6 is an electrical block diagram which depicts electrical circuitry as used with the heat lamp with dispersing fan 10, according to the preferred embodiment of the present invention.

The best mode for carrying out the invention is presented in terms of its preferred embodiment, herein depicted within FIGS. 1 through 5*a* and 6 and in terms of alternate mounting arrangements, herein depicted in FIGS. 5*b*, 5*c*, and 5*d*. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a heat lamp with dispersing fan (herein described as the "apparatus") 10, which provides a portable heating means comprising a heat lamp 62 and a fan 70 to disperse heated air 110. The apparatus 10 is intended for use in spot heating applications providing various mounting arrangements via a multi-functional bracket assembly 20. The apparatus 10 may be installed in a free-standing location on a floor surface 140, clamped thereto wall or ceiling members such as a stud, or incorporated therein existing ductwork 120.

Figure 1:
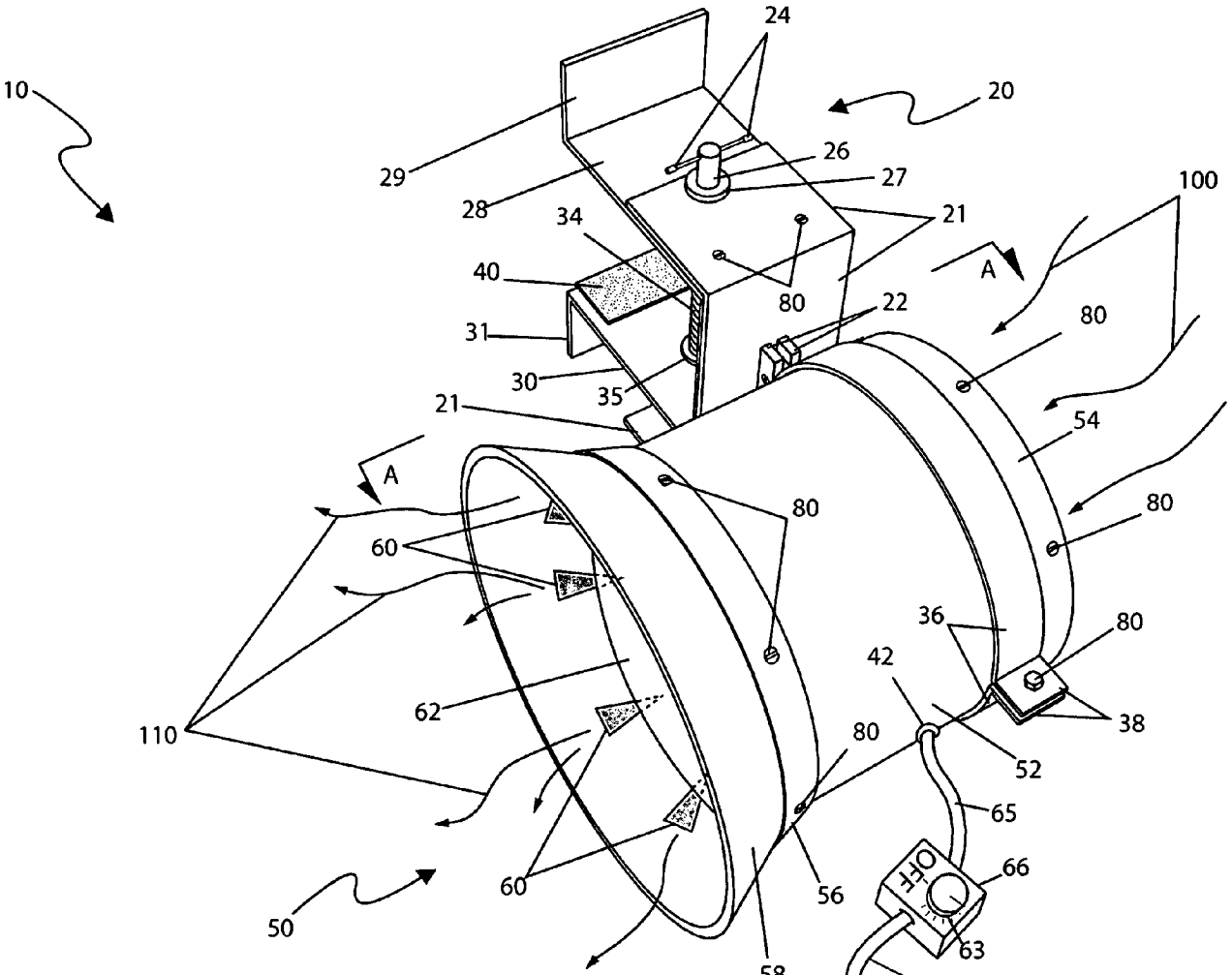
FIG. 1 is a perspective view of a heat lamp with dispersing fan 10, according to the preferred embodiment of the present invention.
Figure 2:
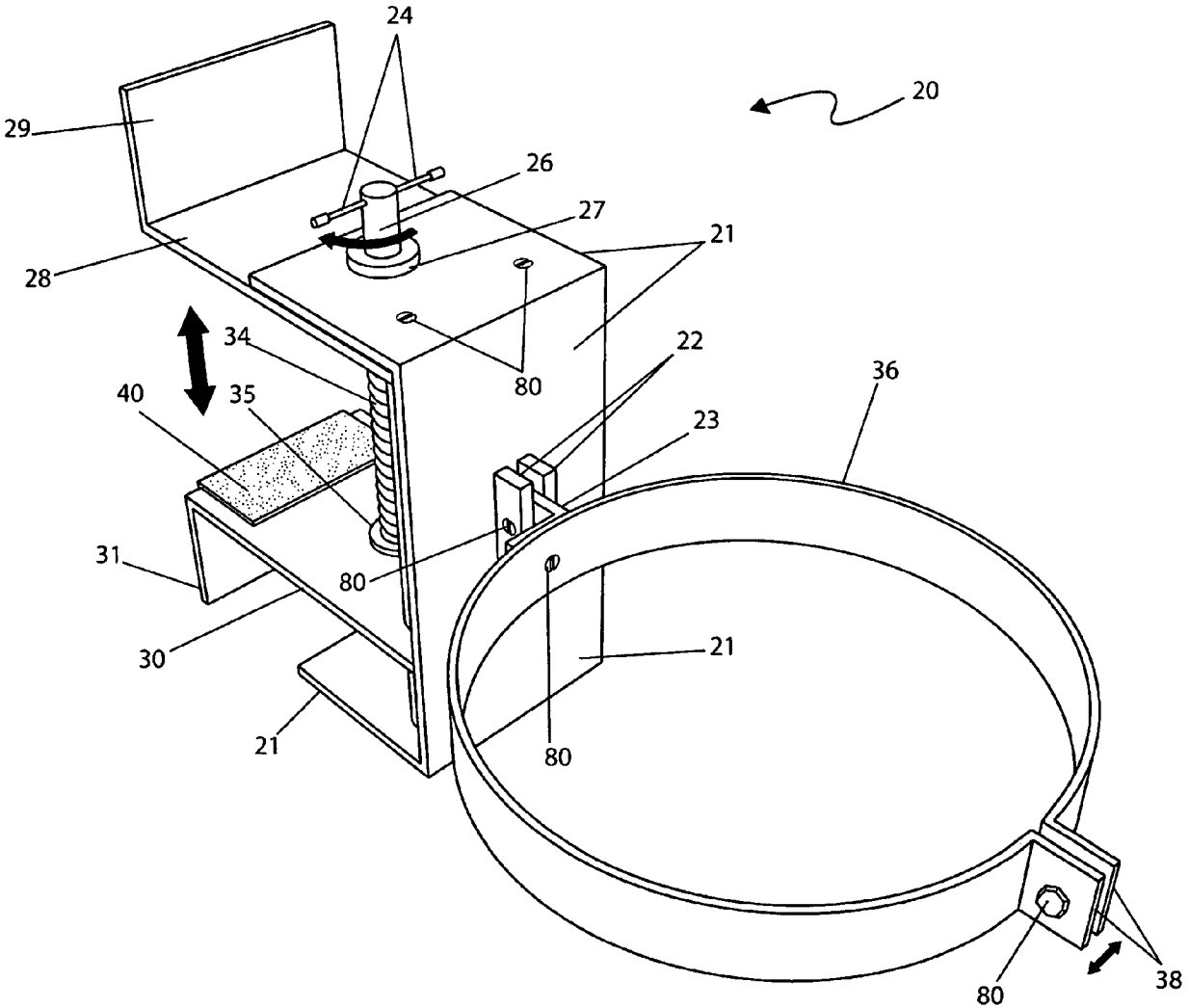
FIG. 2 is a perspective view of a bracket assembly portion 20 of the heat lamp with dispersing fan 10, according to the preferred embodiment of the present invention.

Referring now to FIGS. 1 and 2, perspective views of the apparatus 10, according to the preferred embodiment of the present invention, are depicted. The apparatus 10 comprises a lamp/fan assembly 50 and a bracket assembly 20. The lamp/fan assembly 50 comprises a heat lamp 62 mounted therewithin a cylindrical housing 52. However, it is understood that the apparatus 10 may also utilize a common non-heating illuminating lamp if desired, thereby providing an effective light source to an area. The housing 52 comprises an open-ended cylinder approximately six (6) to eight (8) inches in diameter and approximately twelve (12) to sixteen (16) inches long. The housing 52 is envisioned to be constructed of single or multi-layered galvanized sheet steel, capable of withstanding high temperatures yet providing an exterior surface that will not cause burns or accidental combustion should people or combustible items contact it. The distal end of the housing 52 provides an attachment means thereto a fan cover 54 via common fasteners 80, which houses a muffin-type fan 70 (see FIG. 3). The operation of the fan 70 is such that an incoming flow of cool air 100 is drawn into the housing 52 by the fan 70; heated by the heat lamp 62; and then exhausted as outgoing warmed air 110. Such a feature not only provides for increased warm air 110 dispersal when based upon a heat lamp 62 alone, but the incoming cold air 100 also helps to cool the heat lamp 62 resulting in a cooler operating temperature of said heat lamp 62 and thus, an extended lamp life. Such operational cooling is envisioned to be similar to devices such as a slide projector or overhead projector which keeps a projection lamp cool. It is understood that an actual overall dimension of the lamp/fan assembly 50 would vary based upon a particular installation of the apparatus 10 and availability of various sized heat lamps 62 and fans 70. Electrical power to operate the heat lamp 62 and fan 70 is provided by a power cord 65 affixed thereto using a common rubber grommet 42. The apparatus 10 further comprises a space sensing ambient thermostatic controller 66 mounted in an in-line manner along the power cord 65 (see FIGS. 3 and 6).

The bracket assembly 20 provides an adjustable and multi-functional device capable of positioning the apparatus 10 at various mounting arrangements (see FIGS. 5*a* through 5*d*). The bracket assembly 20 also provides three (3) axis directional positioning of the lamp/fan assembly 50. The bracket assembly 20 further comprises a bracket base 21, a pair of first pinch plates 22, an angle bracket 23, an adjusting handle 24, an adjusting shaft 26, a retaining ring 27, a stationary jaw 28, a movable jaw 30, a clamping ring 36, and a pair of second pinch plates 38. The bracket base 21 comprises a channel or "U"-shaped metal structure providing an attachment means thereto several multi-axis adjustable fixtures to direct and position the lamp/fan assembly 50 based upon surrounding objects, available mounting structures, desired heating objectives, and a user's preference. The stationary jaw 28 and movable jaw 30 are located at a distal inner space of the "U"-shaped bracket base 21 providing a variable gap therebetween said stationary jaw 28 and movable jaw 30 as defined thereby rotary adjustment of the adjusting handle 24, the adjusting shaft 26, and a threaded shaft 36 in a similar manner as a common workbench vise (see FIG. 4).

Along a proximal surface of the bracket base 21 are a pair of first pinch plates 22 comprising a pair of parallel rectangular metal plates integral thereto and extending perpendicularly therefrom said bracket base 21, thereby providing an attachment means thereto the angle bracket 23. Said first pinch plates 22 further comprise a particular relative gap therebetween so as to slidingly receive and affix an angle bracket 23 using common fasteners 80 such as a nut and bolt combination. The angle bracket 23 comprises a metal shape formed at a right-angle having extended elements approximately two (2) inches long, each having centrally located fastening apertures allowing respective attachment thereto the first pinch plates 22 and the clamping ring 36 using common fasteners 80. The first pinch plates 22 provide a rotary connection thereto the angle bracket 23 and affixed clamping ring 36, thereby allowing angular adjustment and securing of the clamping ring 36 and the lamp/fan assembly 50 thereto a desired tilting angle as illustrated here. The clamping ring 36 in-turn provides an adjustable attachment means thereto the aforementioned lamp/fan assembly 50. The clamping ring 36 comprises a circle-shaped metal strap having a corresponding inner diameter to that of the housing portion 52 of the lamp/fan assembly 50, thereby allowing linear adjustment and clamping thereof via a pair of second pinch plates 38 and a fastener 80. Loosening and tightening of said fastener 80 causes a gap therebetween the second pinch plates 38 to reduce and increase respectively, thereby allowing sliding engagement of the lamp/fan assembly 50 therewithin the clamping ring 36 and subsequent secure clamping thereof using said second pinch plates 38.

Referring next to FIG. 3, a section view taken along section A-A (see FIG. 1) of the apparatus 10, according to the preferred embodiment of the present invention, is disclosed. This figure more clearly depicts the internal construction of the lamp/fan assembly portion 50 of the apparatus 10. The lamp/fan assembly 50 further comprises a grommet 42, a fan cover 54, an inlet air vent 57, a conical-shaped visor 58, a plurality of outlet air vents 60, a thermostatic controller 66, a plurality of internal wiring 67, an over-temperature limit cutoff switch 68, a terminal strip 69, and a lamp socket 72. The housing 52 comprises an open-ended cylinder providing insertion and attachment of a conical-shaped visor 58 which provides a housing means thereto the aforementioned heat lamp 62. The visor 58 further comprises a plurality of equally-spaced outlet air vents 60 arranged radially along a minor diameter portion of the visor 58 being adjacent thereto the heat lamp 62, thereby directing a flow of cool air 100 over said heat lamp 62 and raising a temperature of said cool air 100 as it exits the housing 52. The heat lamp 62 is connected to a commercially available lamp socket 72 comprising materials and construction designed to accommodate high temperatures encountered during operation of the apparatus 10. Any insulating parts of the lamp socket 72 are envisioned to be constructed of ceramic materials. The lamp socket 72 is affixed thereto the visor 58 using a plurality of equal-spaced common fasteners 80.

The opposing open end portion of the housing 52 provides an attachment means thereto the fan 70 being snuggly inserted thereinto said open end portion and secured along a perimeter region using common fasteners 80. The fan 70 comprises a round or rectangular commercially available muffin-type fan unit common in the industry. The fan cover 54 comprises a cylindrical cover form providing a protective covering means thereto the fan 70 as well as a closure means thereto the open end portion of the housing 52.

The fan cover 54 comprises a shallow cylinder-shaped metal enclosure having an inner diameter particularly sized so as to slidingly receive the circular housing 52 therein, being secured thereto using common fasteners 80 such as sheet-metal screws along outer surfaces as shown here. Furthermore, the fan cover 54 comprises a circular inlet air vent 57 approximately four (4) inches in diameter located along an end portion allowing a sufficient cool air flow 100 to move therethrough.

Electrical power is supplied thereto the lamp/fan assembly 50 via a common household 110-volt circuit being controlled in an ON/OFF fashion via an in-line thermostatic controller 66. The thermostatic controller 66 provides activation of the lamp/fan assembly 50 based upon a sensed ambient temperature and a user selected set point using an external set-point dial 63 along a front face thereof. The set-point dial 63 also provides an ON/OFF function thereat an extreme rotary position. Said thermostatic controller 66 comprises a commercially available device providing a protective rectangular plastic housing and a common mechanically-adjustable bimetallic rotary switch; however, other similarly functioning relay devices may also be provided as well, to maintain a selectable ambient temperature therein a living space. Electrical current is in-turn conducted thereto an over-temperature limit cutoff switch 68 mounted thereto an interior surface of the housing 52. A terminal strip 69, also mounted therewithin the housing 52, provides distribution of said electrical current thereto the fan 70 and the heat lamp 72 via common internal wiring 67.

This figure more clearly displays the incoming cold air 100 entering the inlet air vent portion 57 of the fan cover 54; being motioned via the fan 70; passing therethrough the outlet air vents 60; being warmed by the hot surface of the heat lamp 62; exiting the visor 58; and entering a living area as outgoing warmed air 110.

Referring now to FIG. 4, a rear perspective view of a bracket assembly portion 20 of the apparatus 10, according to the preferred embodiment of the present invention, is disclosed. The bracket assembly 20 further comprises a retaining ring 27, a pair of guide rods 32, a threaded shaft 34, a stationary nut 35, and a pair of pads 40. As previously described, the bracket assembly 20 comprises a pair of clamping jaws 28, 30 providing converging and diverging parallel surfaces allowing clamping of the apparatus 10 thereto structural members such as a stud, a ceiling joist, or a door frame. The stationary jaw 28 is affixed to an upper plate portion of the bracket base 21 therealong a lower surface preferably via welding, soldering, or the like. The movable jaw 30 is retained thereat a parallel relationship thereto said stationary jaw 28 via a pair of guide rods 32, such that the threaded shaft 34 being engaged therewith said movable jaw 30 in a perpendicular manner. The guide rods 32 slidingly engage the movable jaw 30 via a pair of close-tolerance guide rod apertures 33, while the threaded shaft 34 acts to drive the movable jaw 30 by utilizing a mechanical advantage therefrom an external thread portion of said threaded shaft 34 and a stationary nut portion 35 being welded thereto an upper surface of the movable jaw 30. This arrangement forms a conventional screw mechanism to motion said movable jaw 30 in an upward and downward direction relative to the stationary jaw 28. The adjusting handle 24, adjusting shaft 26, retaining ring 27, and threaded shaft 36 comprise a one-piece linear assembly allowing a user to separate, adjust, and tighten said jaws 28, 30 thereupon said structural members in a similar manner as a vise handle.

The jaw portions 28, 30 may also be utilized to position the apparatus 10 along a normal floor surface 140 in a stable manner via respective first foot 29 and second foot 31 portions. The first foot 29 and second foot 31 portions comprise integral appendages of said jaws 28, 30 being formed outwardly at right angles in an opposing arrangement along a common plain. The apparatus 10 may rest in a secure manner during use on a floor surface 140 by maximizing a relative gap therebetween the jaws 28, 30, thereby producing a wide stance thereof. Additional stability during clamping and floor mounting configurations is accomplished via a pair of rubber anti-skid pads 40 affixed thereto inward facing surfaces of said jaws 28, 30 using a common adhesive and extending outwardly, also covering a majority portion of the foot areas 29, 31. Each pad 40 comprises a wide layer of a high-friction material such as natural rubber, urethane, or the like.

Referring now to FIG. 5*a*, an environmental view of the heat lamp with dispersing fan 10, depicting a floor standing arrangement, according to the preferred embodiment of the present invention, is disclosed. Installation of the apparatus 10 thereupon a floor surface 140 enables directional manipulation of the lamp/fan assembly 50 to be varied to suit individual usage requirements. While using the apparatus 10 upon said floor surface 140, the apparatus 10 provides effective spot heating thereto a specific area therewithin a home, work area, garage, and the like. Additionally, the light provided by the heat lamp 62 or an alternate illuminating lamp, may supplement ambient lighting and provide needed task lighting if required.

Referring now to FIGS. 5*b*, 5*c*, and 5*d*, environmental views of the apparatus 10, depicting alternate mounting arrangements along a wall, ceiling, and in a duct, respectively, of the present invention, is disclosed. Clamping of the apparatus 10 thereto a wide variety of exposed structural members 160 of a wall or ceiling is accomplished by using the previously described adjustment and clamping functions of the stationary 28 and adjustable 30 jaws. In use, a user positions the apparatus 10 along said structural member 160 such as a stud, and rotates the adjusting handle 24 to reduce a gap therebetween said stationary 28 and adjustable 30 jaws to secure the bracket assembly 20 in place. The lamp/fan assembly 50 is then positioned and secured using the directionally adjustable angle bracket 23 and clamping ring portions 36 of the apparatus 10. The apparatus 10 remains stable during clamping via the rubber anti-skid pads 40. The bracket assembly 20 would be clamped to a suitable structural member 160 as previously described using the jaws 28, 30 to allow support of the apparatus 10. Additionally, suitable space between the housing 52 and wall and ceiling portions would be provided by the bracket assembly 20 so as to allow an adequate flow of incoming cool air 100.

Configuration of the apparatus 10 therewithin a duct 120, as depicted in FIG. 5*d*, would be used with existing or new forced air heating system ductwork 120 as a supplemental heat source. Furthermore, configuration of the apparatus 10 therewithin said ductwork 120 would require removal of the bracket assembly 20 therefrom the apparatus 10. Following installation and positioning of the lamp/fan assembly portion 50 of the apparatus 10 therewithin said duct 120, an air flow through a section of heating duct 120 would be directed therethrough the apparatus 10. The apparatus 10 comprises a plurality of supporting sheet-metal duct brackets 130 to securely position the lamp/fan assembly 50 therewithin said ductwork 120 such that a flow of air proceeding therewithin said duct 120 enters the apparatus 10; is then supplementally heated; and exhausted thererinto a room area. Such an arrangement may be used with HVAC systems that provide output louvers at the top or ceiling surface 150 of a room or space. As such, the apparatus 10 is located adjacent to, or on a ceiling surface 150. The apparatus 10 along with the heating duct 120 is envisioned to be located in an inaccessible space such as an attic area. This would allow the lamp/fan assembly 50 to warm a living space as well as provide possible access and maintenance thereto the lamp/fan assembly 50. The features of the apparatus 10 provide warming of air 110 by the heat lamp portion 62 as it exits and continues down the heating duct 135 to the living space 143. It is envisioned that the apparatus 10 may use the aforementioned thermostatic controller 66 or may be controlled in a joint manner using existing controls incorporated therein a conventional forced air heating system while the forced air system is operated in a normal manner.

Utilization of the apparatus 10 in a ceiling mount configuration may allow positioning of the lamp/fan assembly 50 in a downwardly directed manner along a ceiling surface 150. This configuration is envisioned to allow the apparatus 10 to provided normal or ambient heating for any occupied space without reliance on other heating sources. Additionally, the light provided by the heat lamp 62 may provide a high level lighting means for a space as well. Such a configuration is viewed as appropriate in areas such as warehouse areas, gymnasiums, and other high ceiling areas where normal lighting and normal heating is a challenge.

Figure 6:
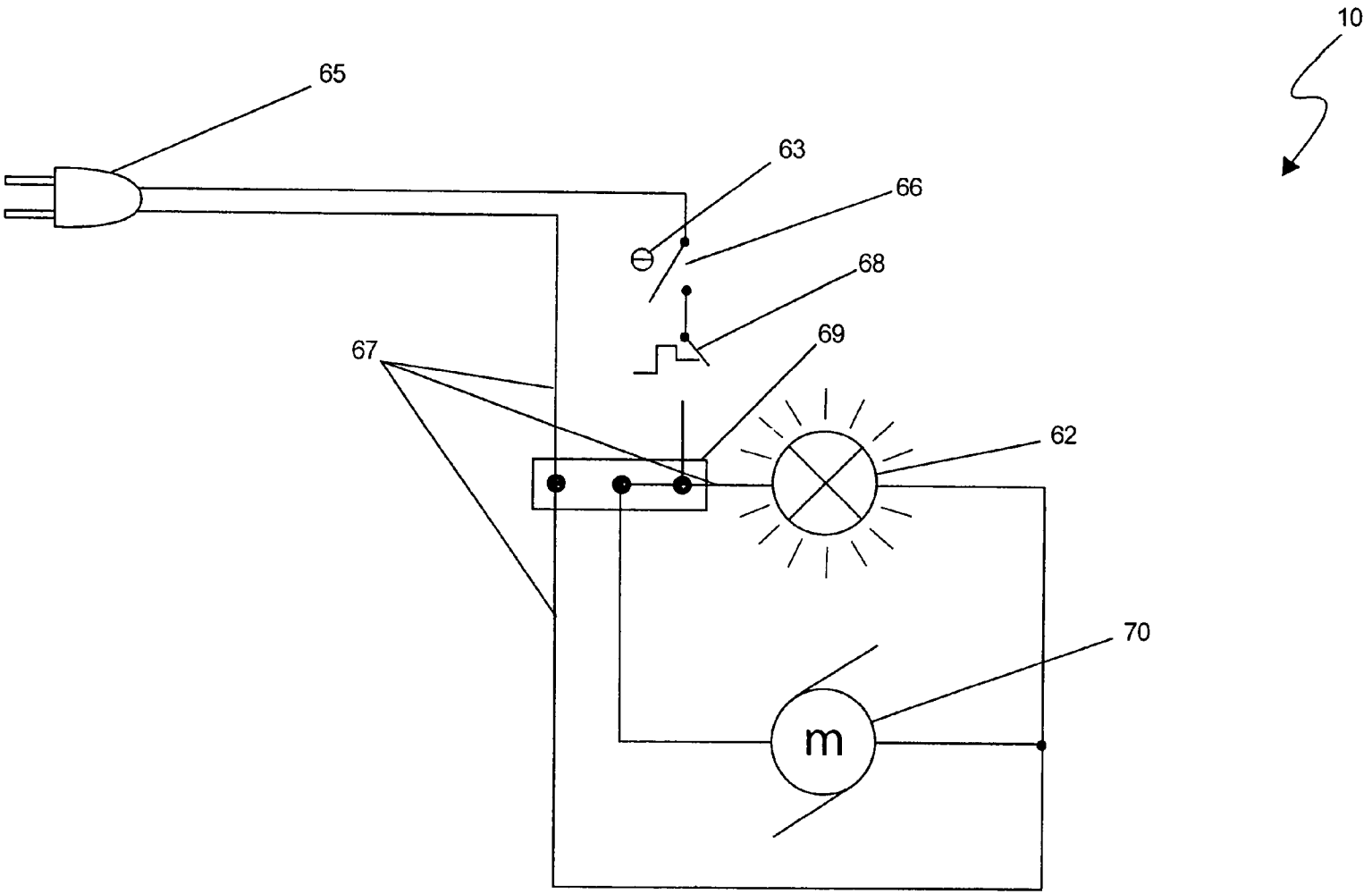

Referring now to FIG. 6, an electrical block diagram which depicts the electrical circuitry as used with the apparatus 10, is disclosed. Power for the apparatus 10 is obtained from any available 110-volt AC electric source; however, it is understood that hard-wiring thereto a 220-volt circuit may be utilized in conjunction with appropriate electrical portions of the apparatus 10 with equal benefit based upon operational current limitations and/or availability of said electrical components. Electrical power is then routed thereto the thermostatic controller 66 as shown. It is envisioned that the thermostatic controller 66 may be located in a living space or otherwise remote location therefrom the apparatus 10 so as to not be affected by an immediate output of warmed air 110 therefrom the apparatus 10. Power is then routed thereto the over-temperature limit cutoff switch 68 and subsequently thereto the terminal strip 69. The over-temperature limit cutoff switch 68 is designed to shutoff the apparatus 10 in case of erroneous operation outside of designed temperature limits. Such erroneous operation may occur due to failure of the fan 70, a blocked inlet air vent 57, over-voltage or under-voltage conditions of the power cord 65, and other such anomalies. It is envisioned that conventional control of the apparatus 10 would be provided by the thermostatic controller 66 located in an in-line fashion therein the power cord 65, and the over-temperature limit cutoff switch 68, both being wired in a series connection. The over-temperature limit cutoff switch 68 comprises a conventional over-temperature component similar to those used on clothes dryers and other heating appliances designed to open at high temperature levels and remain open until an ambient space returns thereto a safe temperature. The terminal strip 69 provides connections to conduct said current thereto the heat lamp 62 and the fan 70 via internal wiring 67 in a parallel arrangement as shown.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be installed and utilized by the common user in a simple and effortless manner with little or no training. It is envisioned that the apparatus 10 would be provided as illustrated in FIGS. 1 through 4 and installed in accordance with FIGS. 5*a* through 5*d*, as desired.

The method of installing the apparatus 10 may be achieved by performing the following steps: configuring the apparatus 10 for standing thereupon a floor surface 140 by maximizing a relative gap therebetween the jaw portions 22, 30 using the adjusting handle 24 and integral threaded shaft 34; placing the apparatus 10 securely thereupon said floor surface 140 using the foot portions 29, 31 and anti-skid pads 40; manipulating a position and direction thereof the lamp/fan assembly 20 using the angle bracket 23, and the clamping ring 36, using the respective fasteners 80.

The method of installing the apparatus 10 utilizing an alternate mounting arrangement such as along a wall, ceiling, or in a heat duct, may be achieved by performing the following steps: clamping the apparatus 10 thereto available wall or ceiling members such as studs and joists by positioning and clamping said apparatus 10 thereto said members using the jaws 28, 30; closing a respective gap therebetween said jaws 28, 30 using the adjustment handle 24 and threaded shaft 34; manipulating a position and direction thereof the lamp/fan assembly 20 as previously described.

Installing the lamp/fan assembly portion 50 of the apparatus 10 therewithin a duct portion 120 of an existing or newly installed heating system by removing the bracket assembly 20; attaching the lamp/fan assembly 20 securely thereto said duct 120 along a ceiling surface 150 using a plurality of duct brackets 130 based upon a particular installation conditions using common fasteners 80 such as sheet metal screws; utilizing the thermostatic controller 66 to control the apparatus 10 or integrating the lamp/fan assembly 20 thereinto the existing heating system control equipment.

During physical installation of the apparatus 10, proper attention must be paid to clearance and airflow requirements to ensure proper operation so as to prevent overheating and inadvertent shutdown of the apparatus 10.

Once installed in a desired location, the method of utilizing the apparatus 10 may be achieved by performing the following steps: connecting the power cord 65 thereto a suitable source of electricity; energizing the apparatus 10 and selecting a suitable heating temperature to be maintained using the set-point dial portion 63 of the thermostatic controller 66; applying electrical power to the heat lamp 15 and to the fan 25 when a low ambient temperature is detected causing the thermostatic controller 66 to close an internal relay portion; heating up the heat lamp 62 in an expected manner; powering the fan 25, thereby motioning a flow of cool air 100 therethrough the inlet air vent 57; moving the incoming cold air 100 over the lamp/fan assembly 50 via the outlet air vents 60; exhausting said outgoing warmed air 110, thereinto a living space; obtaining a suitable increased temperature therewithin said living space being sensed thereby the thermostatic controller 66; opening a relay portion of said thermostatic controller 66 to cease electrical current supplied thereto the heat lamp 62 and fan 70, thereby completing a heating cycle of the apparatus 10; repeating said heating cycle as needed to maintain the living space at an appropriate temperature; and, benefiting from a portable automatic spot heating of various living areas using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable heating means, comprising:

a housing comprising a mounting assembly;

an illuminating means located at a proximal end of said housing; and, a fan assembly located at a distal end of said housing;

wherein said mounting assembly further comprises:

a bracket base comprising a channeled structure;

a stationary jaw affixed to an upper plate portion of said bracket base and comprising a first foot with an anti-skid pad;

a movable jaw located at a second distal inner space of said bracket base and comprising a second foot with an anti-skid pad; and, an adjusting means for moving said movable jaw relative to said stationary jaw;

wherein said mounting assembly provides an adjustable and multi-functional device capable of positioning said portable heating means at a desired mounting arrangement;

wherein said movable jaw is variably adjustable to said stationary jaw to provide a clamping means to a support object thereinbetween;

wherein said fan assembly produces a forced flow of air;

wherein said illuminating means heats said forced flow of air to produce a heated flow of air; and, wherein said portable heating means disperses said heated flow of air thereout.

2. The portable heating means of claim 1, wherein said housing further comprises an open-ended cylinder comprising an attachment means thereto said fan assembly thereat said distal end and a housing flange thereat said proximal end;

wherein an incoming flow of air enters said housing thereat said distal end;

wherein said heated flow of air exits said housing thereat said proximal end;

wherein said housing is fabricated out of a material able to withstand elevated temperatures;

wherein said housing provides an exterior surface that will not cause burns or accidental combustion should people or combustible items contact it.

3. The portable heating means of claim 2, wherein said housing further comprises a conical-shaped visor attached thereto said housing flange, further comprising a plurality of radial outlet air vents equidistantly spaced thereabout adjacent thereto said illumination means;

wherein said force flow of air travels therethrough said plurality of radial outlet air vents thereto said illumination means.

4. The portable heating means of claim 3, wherein said housing comprises a diameter of approximately six (6) to eight (8) inches and a length of approximately twelve (12) to sixteen (16) inches.

5. The portable heating means of claim 1, wherein said adjusting means further comprise:

a pair of guide rods, each comprising an upper end attachable thereto said upper plate portion thereof said bracket base and said stationary jaw, and a lower end thereto said lower plate portion thereof said bracket base;

an adjusting shaft affixed thereto an outside surface thereof said movable jaw therewith a stationary nut, through said stationary jaw, and thereto said upper plate portion thereof said bracket base therewith a retaining ring; and, an adjusting handle for providing a force thereto said adjusting shaft;

wherein said pair of guide rods maintain a slidingly engaging and parallel relationship therebetween said stationary jaw and said movable jaw;

wherein said adjusting shaft provides a driving force thereto said movable jaw relative thereto said stationary jaw.

6. The portable heating means of claim 1, wherein said mounting assembly further comprises:

an angle bracket;

a pair of first pinch plates extending perpendicularly therefrom a proximal surface thereof said bracket base and comprising a gap to slidingly receive and affix said angle bracket;

a clamping ring comprising a circular strap with a first end affixed thereto said angle bracket and a second end; and, a pair of second pinch plates located thereat said second end thereof said clamping ring;

wherein said pair of first pinch plates provide a rotary connection thereto said angle bracket and said clamping ring, thereby allowing angular adjustment and securing of said clamping ring and said housing thereto a desired tilting angle;

wherein said clamping encircles said housing; and, wherein said pair of second pinch plates provide a linear adjustment means and a clamping means therefor said mounting assembly thereto said housing.

7. The portable heating means of claim 3, wherein said illumination means further comprises:

a lamp socket affixed thereto said visor using a plurality of equidistantly-spaced fasteners; and, a heat lamp removably attached therein said lamp socket;

wherein said heat lamp heats said forced flow of air and produces said heated flow of air.

8. The portable heating means of claim 6, wherein said fan assembly further comprises:

a fan cover comprises a cylindrical cover for slidingly receiving said distal end thereof housing and secured thereto and further comprising a circular inlet air vent; and, a fan inserted thereinto said distal end thereof said housing and secured thereinto;

wherein said inlet air vent directs said incoming flow of air thereto said fan; and, wherein said fan produces said forced flow of air.

9. The portable heating means of claim 8, wherein said fan comprises a muffin-type fan.

10. The portable heating means of claim 8, further comprising a control means thereof said illumination assembly and said fan assembly, further comprising:

a power cord in electrical communication therewith a power source;

an thermostatic controller in electrical communication therewith said power cord providing an ON/OFF function thereto said portable heating means based upon a sensed ambient temperature and a pre-selected set point;

a set-point dial located on a front face thereof said thermostatic controller for providing a means to enter said pre-selected set-point temperature and also providing said ON/OFF function;

an over-temperature limit cutoff switch mounted thereto an interior surface thereof said housing and in electrical communication therewith said thermostatic controller; and, a terminal strip mounted thereto an interior surface thereof said housing and in electrical communication therewith said over-temperature limit cutoff switch for distributing electrical current thereto said illumination assembly and said fan assembly via electrical wiring;

wherein said over-temperature limit cutoff switch arrests power thereto said portable heating means due to erroneous operation outside of designed temperature limits.

11. The portable heating means of claim 10, wherein said thermostatic controller is located at an external position thereto said housing not adjacent thereto said heated flow of air.

12. A method of utilizing a portable heating means comprises the following steps:

providing said portable heating means, further comprising:

an open-ended cylinder comprising an attachment means thereto said fan assembly thereat said distal end and a housing flange thereat said proximal end;

a conical-shaped visor attached thereto said housing flange, further comprising a plurality of radial outlet air vents equidistantly spaced thereabout adjacent thereto said illumination means;

a bracket base with an angle bracket;

a pair of first pinch plates extending perpendicularly therefrom a proximal surface thereof said bracket base and comprising a gap to slidingly receive and affix said angle bracket;

a stationary jaw affixed thereto an upper plate portion thereof said bracket base and comprising a first foot with an anti-skid pad;

a movable jaw located at a second distal inner space thereof said bracket base and comprising a second foot with an anti-skid pad;

a pair of guide rods, each comprising an upper end attachable thereto said upper plate portion thereof said bracket base and said stationary jaw, and a lower end thereto said lower plate portion thereof said bracket base;

an adjusting shaft affixed thereto an outside surface thereof said movable jaw therewith a stationary nut, through said stationary jaw, and thereto said upper plate portion thereof said bracket base therewith a retaining ring;

an adjusting handle for providing a force thereto said adjusting shaft;

a clamping ring comprising a circular strap with a first end affixed thereto said angle bracket and a second end;

a pair of second pinch plates located thereat said second end thereof said clamping ring for affixing said clamping ring thereto said housing;

an illuminating means located at a proximal portion of said housing, comprising a lamp socket affixed thereto said visor using a plurality of equidistantly-spaced fasteners and a heat lamp removably attached therein said lamp socket;

a fan assembly located at a distal end of said housing, further comprising a fan cover comprising a cylindrical cover for slidingly receiving said distal end thereof housing and secured thereto and further comprising a circular inlet air vent, and a fan inserted thereinto said distal end thereof said housing and secured thereinto;

a power cord in electrical communication therewith a power source;

an thermostatic controller in electrical communication therewith said power cord providing an ON/OFF function thereto said portable heating means based upon a sensed ambient temperature and a pre-selected set point;

a set-point dial located on a front face thereof said thermostatic controller for providing a means to enter said pre-selected set-point temperature and also providing said ON/OFF function;

an over-temperature limit cutoff switch mounted thereto an interior surface thereof said housing and in electrical communication therewith said thermostatic controller; and, a terminal strip mounted thereto an interior surface thereof said housing and in electrical communication therewith said over-temperature limit cutoff switch for distributing electrical current thereto said illumination assembly and said fan assembly via electrical wiring;

configuring said portable heating means therefor a desired mounting location;

connecting said power cord thereto said power source, thereby energizing said portable heating means;

selecting said pre-selected set-point temperature therewith said set-point dial of said thermostatic controller;

applying electrical power to said heat lamp and to said fan when a low ambient temperature is detected thereby said thermostatic controller;

heating up said heat lamp;

powering said fan;

motioning an incoming flow of air therethrough said inlet air vent thereto said fan, thereby producing a forced flow of air;

producing a heated flow of air, wherein said forced flow of air passes therethrough said plurality of radial outlet air vents adjacent thereto said heat lamp; and, exhausting said heated flow of air thereinto a outside space until a suitable increased temperature therewithin said outside space is sensed thereby said thermostatic controller, wherein said thermostatic controller de-energizes said portable heating means.

13. The method of claim 12, wherein said step of configuring said portable heating means therefor a floor-mounted location further comprises the steps of:

maximizing a relative gap therebetween said stationary jaw and said movable jaw therewith said adjusting handle and said adjusting shaft;

placing said portable housing means apparatus securely thereupon said desired mounting location thereon a floor surface such that each said anti-skid pad thereof said first foot and said second foot contacts said ground surface; and, manipulating a desired position and direction thereof said housing therewith said angle bracket and said clamping ring and affixing said desired position and direction therewith fasteners.

14. The method of claim 12, wherein said step of configuring said portable heating means therefor a ceiling-mounted location further comprises the steps of:

locating said desired mounting location thereon a ceiling structural member;

clamping said portable heating means thereto said desired mounting location by adjustably moving said movable jaw relative thereto said stationary jaw therewith said adjusting handle and said adjusting shaft; and, manipulating a desired position and direction thereof said housing therewith said angle bracket and said clamping ring and affixing said desired position and direction therewith fasteners.

15. The method of claim 12, wherein said step of configuring said portable heating means therefor a wall-mounted location further comprises the steps of:

locating said desired mounting location thereon a wall structural member;

clamping said portable heating means thereto said desired mounting location by adjustably moving said movable jaw relative thereto said stationary jaw therewith said adjusting handle and said adjusting shaft; and, manipulating a desired position and direction thereof said housing therewith said angle bracket and said clamping ring and affixing said desired position and direction therewith fasteners.

16. The method of claim 12, wherein said step of configuring said portable heating means therefor a ductwork-mounted location further comprises the steps of:

locating said desired mounting location therein a duct;

removing said bracket base and clamping ring therefrom said housing;

attaching said portable heating means securely thereto said duct using a plurality of duct brackets.

17. The method of claim 16, further comprising the step of:

integrating said portable heating means thereinto an existing heating system control means.

* * * * *